United States Patent [19]

Yasuhiro

[11] Patent Number: 4,639,880

[45] Date of Patent: Jan. 27, 1987

[54] RIBBON FEED SYSTEM OF COMBINED PRINTER

[75] Inventor: Miki Yasuhiro, Nagoya, Japan

[73] Assignee: Brother Industries, Ltd., Nagoya, Japan

[21] Appl. No.: 763,467

[22] Filed: Aug. 7, 1985

[30] Foreign Application Priority Data

Aug. 21, 1984 [JP] Japan ..... 59-174721

[51] Int. Cl.[4] ..... B41J 3/58

[52] U.S. Cl. ..... 364/519; 346/44; 400/82

[58] Field of Search ..... 346/44; 364/519; 400/232, 82, 118

[56] References Cited

U.S. PATENT DOCUMENTS 4,527,918 7/1985 Yamamoto et al. ..... 400/82

*Primary Examiner*—Arthur G. Evans

*Attorney, Agent, or Firm*—Kane, Dalsimer, Kane, Sullivan and Kurucz

[57] ABSTRACT

A ribbon feed system of a combined printer equipped with a first printing section and a second printing section selectively rendered operative depending on the type of printing to be performed. The ribbon feed system includes a ribbon drive capable of driving a print ribbon in a manner to suit the condition of printing by one of the two printing sections, a first control unit for controlling the ribbon drive when the first printing section is selected, a second control unit for controlling the ribbon drive when the second printing section is selected, and a control means for switching the printer between the first printing section and second printing section.

2 Claims, 6 Drawing Figures

RIBBON FEED SYSTEM OF COMBINED PRINTER

BACKGROUND OF THE INVENTION

This invention relates to a ribbon feed system of a combined printer capable of printing characters both by using types and by using a series of wires in a row for forming characters in a matrix of dots by feeding a print ribbon intermittently a predetermined distance each time one character is printed or by feeding same continuously depending on the type of printing selected to be performed.

Generally, when printing is performed by using types, it is possible to print characters, symbols, etc., clearly is a well-defined manner. However, limitations are placed on the number of types available for printing characters and symbols and it takes time for a control unit of a printer to select a designated type, making it impossible to increase the speed at which printing is effected beyond a certain limit. When characters are printed by forming a matrix of dots by using a dot printer, a print head is moved at a predetermined speed while wires are selectively actuated in accordance with pattern data. Thus, this type of printer offers the advantage that no limitations are placed on the number of characters to be printed and printing can be performed at high speed. However, the disadvantage associated with this type of printer is that the use of a combination of dots for forming characters makes it difficult to print characters in a clear and well-defined form.

To obviate the aforesaid disadvantage of the prior art, proposals have been made to use a combined printer comprising a first printing section and a second printing section which are moved along a line in which characters are being printed so as to perform the printing of characters both by using types and by using a series of wires in a row. In the combined printer of the prior art, it has been the usual practice to switch the printer between two ribbon feeding modes each time the first printing section or second printing section is selected, so that the print ribbon can be moved a predetermined distance each time one character is printed when the first printing section is selected and the print ribbon can be continuously moved when the second printing section is selected.

The combined printer of the prior art which is switched between the two ribbon feeding modes has suffered the disadvantage that its operativity is low because of the need to switch the printer between the two ribbon feeding modes each time one of the two printing sections is selected.

SUMMARY OF THE INVENTION

This invention has been developed for the purpose of obviating the aforesaid disadvantage of the prior art. Accordingly, the invention has as its object the provision of a ribbon feed system of a combined printer capable of automatically feeding the print ribbon either intermittently a predetermined distance or continuously depending on the type of the printing section selected, thereby improving the operability of the combined printer.

According to the invention, there is provided, in a combined printer comprising a first printing section for printing characters by using types, a second printing section for printing character patterns formed by a matrix of dots and a print ribbon for performing printing as the first printing section and second printing section are moved in a direction in which printing is to be performed in one line, a ribbon feed system comprising a ribbon drive means for moving the print ribbon, a first control unit for controlling the ribbon drive means in such a manner that the print ribbon is fed intermittently a predetermined distance each time one character is printed when the first printing section is rendered operative, a second control unit for controlling the ribbon drive means in such a manner that the print ribbon is continuously fed when the second printing section is rendered operative, and a control circuit for automatically switching the printer between the first printing section and second printing section upon receipt of a signal from an external device or by means of a switch, whereby the first control unit is rendered operative when the first printing section is selected, and the second control unit is rendered operative when the second printing section is selected.

The combined printer provided with the ribbon feed system according to the invention can be automatically switched between the first printing section for printing characters by using types and the second printing section for printing character patterns in a matrix of dots when a signal is supplied from an external device or by means of a switch. When the first printing section is selected, the first control unit is rendered operative to control the ribbon drive means in such a manner that the print ribbon is fed intermittently a predetermined distance each time one character is printed; when the second printing section is selected, the second control unit is rendered operative to control the ribbon drive means in such a manner that the print ribbon is fed continuously.

Thus, the invention provides a ribbon feed system of a combined printer capable of feeding the print ribbon intermittently a predetermined distance each time one character is printed or continuously depending on the type of printing section selected, to thereby improve the operativity of the printer.

DESCRIPTION OF THE PREFERRED EMBODIMENTS

Preferred embodiments of the invention will now be described by referring to the accompanying drawings.

Figure 1:
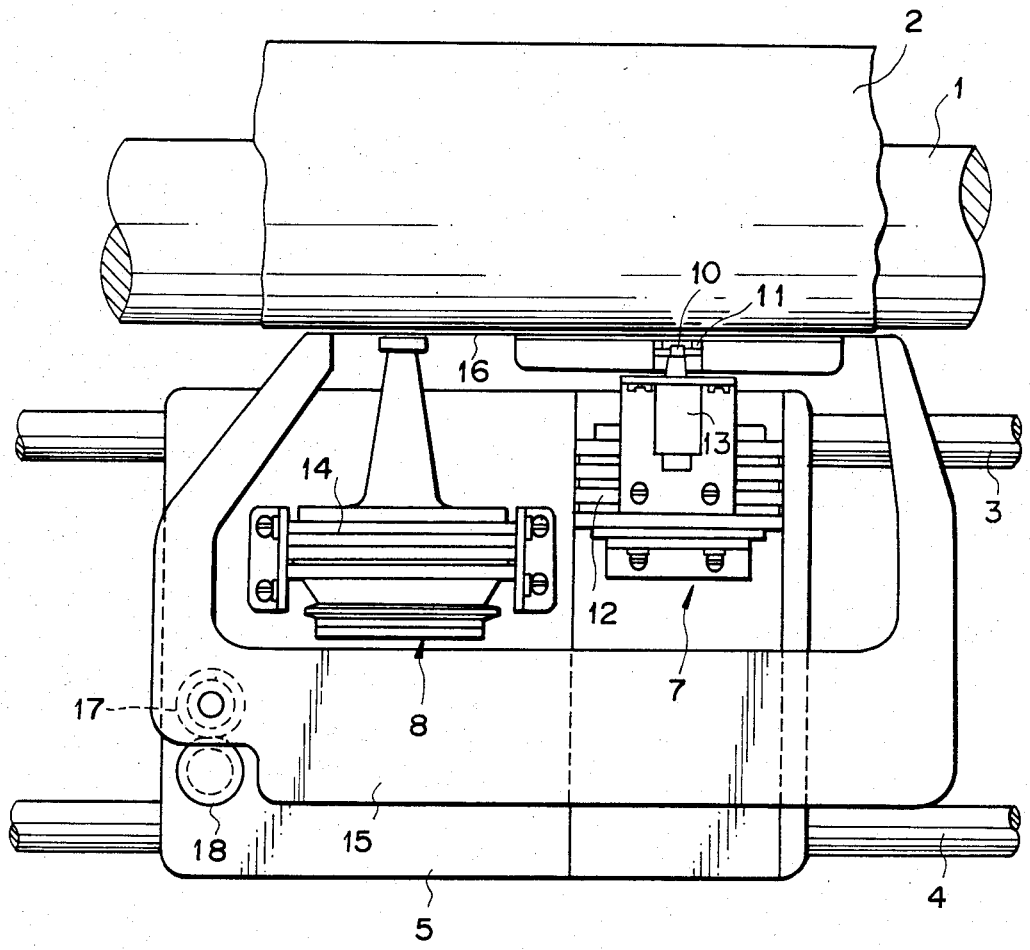
FIG. 1 is a side view of a combined printer in which one embodiment of the ribbon feed system in conformity with the invention is incorporated, showing its printing mechanism.

Referring to FIG. 1 showing the printing mechanism of the combined printer in which the invention is incorporated, a platen 1 is supported by a main body frame, not shown, for rotation, and a platen drive motor 37, such as a step motor, a DC motor, etc., subsequently to be described is drivingly connected to the platen 1. As the platen drive motor 37 is driven for rotation, the platen 1 is rotated through any angle as desired in both directions, to feed a print sheet 2 supported on the platen 1.

Two guide rods 3 and 4 supported by the main body frame extend parallel to the platen 1 for supporting a carriage 5 for a sliding movement axially of the rods 3 and 4. A carriage drive motor 33, such as a step motor, a DC motor, etc., subsequently to be described is drivingly connected to the carriage 5 through a timing belt, not shown, so that the carriage 5 can be moved any distance as desired on the guide rods 3 and 4 along a line of characters to be printed on the print sheet 2. The carriage 5 supports thereon a first printing section 7 and a second printing section 8 located in a side-by-side relation along the platen 1 and spaced apart from each other a suitable distance in the direction parallel to the axis of the platen 1, to print characters, symbols, etc., in the same line on the print sheet 2.

The first printing section 7 comprises a type wheel 11 located in the front of the printing section 7 in a face-to-face relation to the platen 1 and having ninety-six (96) types 10 arranged in a daisy form, a type selection motor 12, such as a step motor, for rotating the type wheel 11 to move the required type 10 to a printing position, and a print hammer 13 striking the selected type 10 at its back to force the type 10 against the print sheet 2 through a print ribbon 16 subsequently to be described. The second printing section 8 comprises a print head 14 having a plurality of print wires, not shown, and electromagnetic means, not shown, mounted therein to print on the print sheet 2 supported on the platen 1 characters in a matrix of dots as the print wires are selectively actuated by electromagnetic means.

Removably mounted on the carriage 5 is a ribbon cassette 15 which contains therein the print ribbon 16 referred to hereinabove in a folded form. The print ribbon 16, which is withdrawn from the ribbon cassette and trained over the first printing section 7 and second printing section 8, is fed by a feed roller 17 and a support roller 18 to which a ribbon drive motor 41 subsequently to be described is connected.

Figure 2:
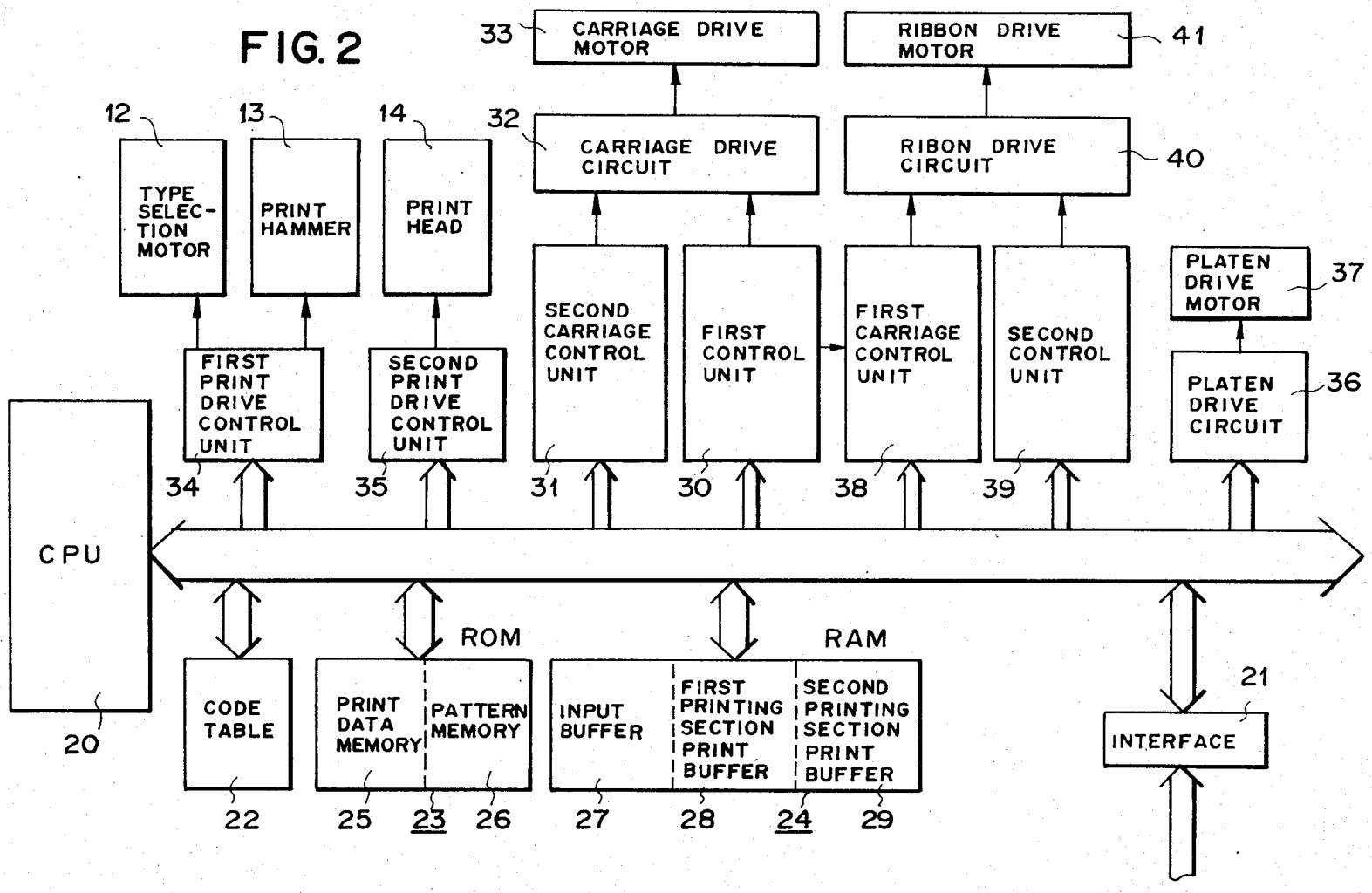
FIG. 2 is a block diagram of one example of the control circuit for the printing mechanism of the combined printer shown in FIG. 1.
Figure 3:
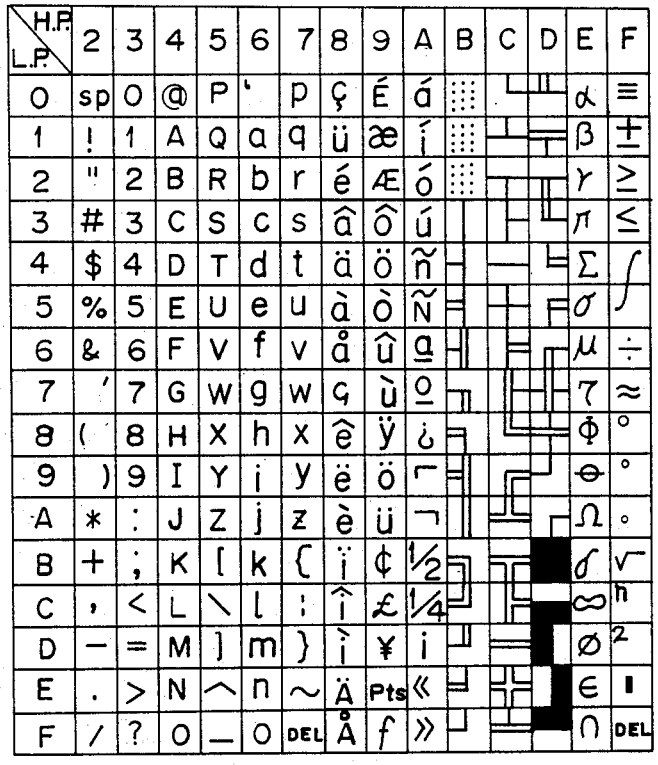
FIG. 3 shows one example of the code table.

FIG. 2 shows one example of the control circuit of the combined printer having the printing mechanism of the foresaid construction, and FIG. 3 shows a code table. A central processing unit (CPU) 20 receives data inputted thereto through an interface 21 from an external device, such as a host computer, not shown. A code table 22, a read-only memory (ROM) 23 and a random access memory (RAM) 24 are connected to the CPU 20. The code table 22 stores therein a multiplicity of codes corresponding to characters and symbols as shown in FIG. 3. More specifically, a combination of a number represented by four digits of higher positions and a number represented by four digits of lower positions constituting one unit of storage positions of eight (8) bits is assigned to each character or symbol as shown in FIG. 3. The storage positions in which the digits of higher positions are from two (2) to seven (7) in FIG. 3 are assigned to types for characters and symbols of ninety-six (96) kinds supported by respective spokes of the type wheel 11, and the rest of the storage positions are assigned to characters and symbols to be printed by means of the print head 14.

The ROM includes a print data memory 25 and a pattern memory 26. Thge print data memory 25 stores therein print data including type selection data for moving any type as desired to a printing position, and impacting data providing an optimum printing pressure to be applied to the print hammer 13 with respect to the area of the selected type. The pattern memory 26 stores therein pattern data on characters and symbols to be printed in a matrix of dots.

The RAM 24 includes an input buffer 27, a first printing section print buffer 28 and a second printing section print buffer 26. The input buffer 27 stores therein data on one line of characters which is inputted to the RAM 24. The first printing section print buffer 28 stores therein print data read out from the print data memory 25 in accordance with the codes of the numbers two (2) to seven (7) represented by the digits of higher positions referred to hereinabove. The second printing section print buffer 29 stores therein pattern data read out from the pattern memory 26 in accordance with the rest of the codes.

Connected to the CPU 20 are a first carriage control unit 30 and a second carriage control unit 31 to which a carriage control circuit 32 is connected. The carriage drive motor 33 is connected to the carriage drive circuit 32. The first carriage control unit 30 is operative, when a type for printing a character by the first printing section 7 is selected, to output an incremental signal to the carriage drive circuit 32 to rotate the carriage drive motor 33 through an angle corresponding to the width of the character, so as to thereby move the carriage 5 a distance corresponding to one character in the direction in which characters and symbols are to be printed in one line. The second carriage control unit 31 is operative, when a character to be printed in a matrix of dots by the second printing section 8 is selected, to output a predetermined velocity signal to the carriage drive circuit 32 so as to rotate the carriage drive motor 33, thereby moving the carriage 5 in the direction in which characters and symbols are to be printed in one line at a predetermined velocity.

Connected to the CPU 20 through a data path is a first print drive control unit 34 to which the type selection motor 12 and print hammer 13 are connected. The first print drive control unit 34 is operative to rotate the type selection motor 12 through the required angle based on the type selection data of the print data inputted thereto from the first printing section print buffer 28, to move the required type 10 to the printing position. Then, the print hammer 13 is actuated to strike the type 10 located in the printing position to apply the optimum pressure thereto in accordance with the impacting data. A second print drive control unit 35 is also connected to the CPU 20, and the print head 14 is connected to the second print drive control unit 35. The second print drive control unit 35 is operative to selectively actuate the print wires of the print head 14 based on the pattern data inputted thereto from the second printing section print buffer 29, to print a desired character or symbol in a matrix of dots on the print sheet 2. Connected to the CPU 20 is a platen drive circuit 36 to which a platen drive motor 37 is connected. The platen drive circuit 36 is operative to drive the platen drive motor 37 in rotation upon receipt of a platen drive signal, to rotate the platen 1 in either the forward or reverse direction and feed the print sheet 2. Connected to the CPU 20 are a first control unit 38 and a second control unit 39 to which a ribbon drive circuit 40 is connnected. A ribbon drive motor 41 is connected to the ribbon drive circuit 40. The first carriage control unit 30 is connected to the first control unit 38 which, when a type to be used by the first printing section 7 to print a character is selected, outputs an incremental signal to the ribbon drive circuit 40 based on a ribbon feed timing signal inputted from the first carriage control unit 30, to thereby drive the ribbon drive motor 41 in rotation in accordance with the width of the character selected and feed the print ribbon 16 a distance corresponding to the width of the character. When a character to be printed in a matrix of dots in the second printing section 8 is selected, the second control unit 39 outputs a continuous ribbon feed signal to the ribbon drive circuit 40, to thereby drive the ribbon drive motor 41 in continuous rotation and continuously feed the print ribbon 16.

Figure 4:
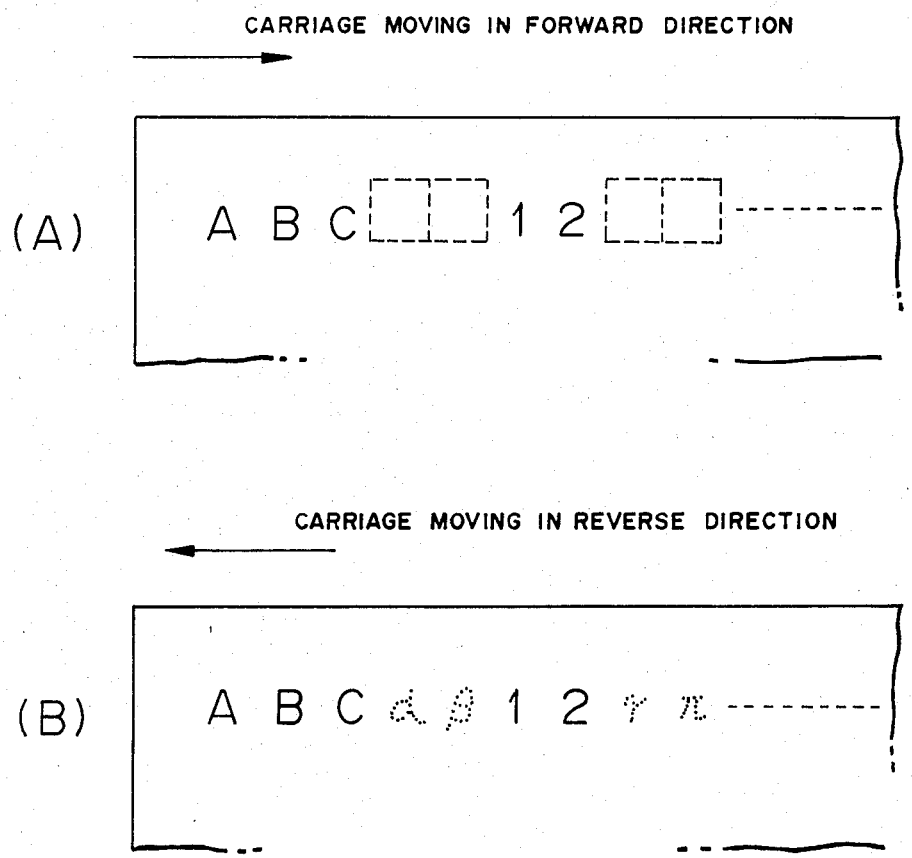
FIG. 4(A) shows the manner in which characters are printed by using types and by means of a series of wires in a row when the print head is moved in one direction.
FIG. 4(B) shows the manner in which characters are printed by using types and by means of a series of wires in a row when the print head is moved in an opposite direction.

The operation of printing characters by means of types and matrixes of dots in one line on the print sheet 2 on the platen 1 will be described by referring to FIGS. 4(A) and 4(B).

As data for printing characters, symbols, etc., by using types and data for printing characters, symbols, etc., in a matrix of dots are inputted in a mingling condition through the interface 21 to the CPU 20 from an external device, the CPU 20 causes the data to be successively stored in the input buffer 27. When the data on characters, symbols, etc., to be printed in one line is stored in the input buffer 27, the CPU decides, by referring to the code table 22, whether the data inputted to the input buffer 27 is data for performing printing by using types having assigned thereto the storage positions in which the numbers designated by the digits of higher positions are two (2) to seven (7) or for performing printing in a matrix of dots to which storage positions other than those referred to hereinabove are assigned as shown in FIG. 3. When the data is for printing characters, symbols, etc., by using types, the CPU 20 reads out, based on such data, data on types from the type data memory 25 and substitutes space data or tab data for the positions of the digits in which printing is to be performed in a matrix of dots in the one line in which characters, symbols, etc., are to be printed. Thus, the CPU 20 edits data by using data on types and space data or tab data and transfers the edited data to the first printing section print buffer 28. When the data is for printing characters, symbols, etc., in a matrix of dots, the CPU 20 reads out, based on such data, pattern data from the pattern memory 26 and substitutes space data or tab data for the positions of the digits in which printing is to be effected by using types in the one line in which characters, symbols, etc., are to be printed. That is, the CPU 20 edits data by using data on types and space data or tab data and transfers the edited data to the second printing section print buffer 29.

The CPU 20, when printing is first performed by using a type based on a type printing command signal supplied from the external device, selects the first carriage control unit 30 and first control unit 38 based on the type printing command signal. The CPU 20 outputs type data read out from the first printing section print buffer 28 based on the type printing command signal to the first print drive control unit 34 and drives the type selection motor 12 in rotation based on type selection data, so as to move the desired type 10 to the printing position. Then, the CPU 20 actuates the print hammer 13 based on impacting data to force the type 10 against the print sheet 2 through the print ribbon 16 to print the desired character on the print sheet 2. After the character is printed by using the type 10, the first carriage control unit 30 outputs an incremental signal to the carriage drive circuit 32 to move the carriage 5 in one direction a distance corresponding to the width of one character pitch along a line in which characters, symbols, etc., are to be printed. As the carriage 5 begins to move, the first control unit 38 outputs an incremental signal to the ribbon drive circuit 40 based on a HIGH ribbon feed timing signal inputted from the first carriage control unit 30, to thereby feed the print ribbon 16. When the ribbon feed signal is switched to LOW, the ribbon feed is interrupted. Thus, the print ribbon 16 can be fed for one character as the carriage 5 moves. The operations described hereinabove are repeatedly performed, so that the CPU 20 enables characters to be printed by using the types 10 while moving the carriage 5 in one direction along the line in which characters, symbols, etc., are to be printed and leaving blank (indicated by broken line blocks) the digit positions in which printing is to be performed by using a matrix of dots, as shown in FIG. 4(A).

Upon completion of the printing of characters by using the types 10, the CPU 20 selects the second carriage control unit 31 and second control unit 39 based on a dot matrix printing command signal inputted from the external device. Then, the second carriage control unit 31 outputs a constant velocity signal to the carriage drive circuit 32 which drives the carriage drive motor 33 to continuously rotate, so as to move the carriage 5 in an opposite direction at a constant velocity along the line of characters, symbols, etc., printed by using the types 10 when the carriage 5 moves in one direction. The second control unit 39 outputs a continuous feed signal to the ribbon drive circuit 40 which drives the ribbon drive motor 41 to continuously rotate, to thereby continuously feed the print ribbon 16. The CPU 20 outputs to the second printing drive control unit 35 the pattern data and the space data or tab data read out from the second printing section print buffer 29, as the carriage 5 is moved in the opposite direction at a constant speed and the print ribbon 16 is continuously fed. Thus, desired characters, symbols, etc., are printed in a matrix of dots in the digit positions which have previously been left blank when characters, symbols, etc., were printed by using the types 10.

In the foregoing description, the data for printing characters, symbols, etc., in one line which is inputted from the external device has been described as containing data for printing characters by using the types and data for printing characters in a matrix of dots in an intermingling condition, and the CPU 20 has been described as deciding whether the data is for printing characters, symbols, etc., by using the types 10 or for printing them in a matrix of dots after studying the codes of the inputted data by referring to the code table 22. However, according to the invention, it is possible to select printing by using the types 10 or printing in a matrix of dots in accordance with printing mode designation data inputted from an external device or by means of a change-over switch and to print characters, symbols, etc., in accordance with the inputted data only by using the types 10 or in a matrix of dots. When characters, symbols, etc., are printed by using the types 10 in accordance with the inputted data, it is possible to print them by using the characters by directly outputting type data read out from the type data memory 25 to the first printing drive unit 34 without having it pass through the first printing section print buffer 28.

The invention has been described as printing characters, symbols, etc., by using the types 10 when the carriage 5 is moved in one direction and as printing them in a matrix of dots when the carriage 5 is moved in the reverse direction. However, this is not restrictive and the order in which printing is effected by using the types 10 and matrixes of dots may be reversed. If desired, printing may be first effected by using the types 10 when the carriage 5 is moved in one direction and then effected in a matrix of dots by moving the carriage 5 again in the same direction after moving the carriage 5 in the reverse direction along the line of printed characters and symbols to the position in which the printing was initiated.

From the foregoing description, it will be appreciated that, in the ribbon feed system according to the invention, the first control unit 38 is rendered operative when the carriage 5 is moved in one direction to perform by using the types 10 based on type data by the first printing section 7 while feeding the print ribbon 16 in a predetermined amount each time a character or symbol is printed, and that the second control unit 39 is rendered operative when the carriage 5 is moved in the reverse direction to perform printing in a matrix of dots based on pattern data by the second printing section 8 while continuously feeding the print ribbon 16. Thus, it is possible for the combined printer to continuously print characters, symbols, etc., either in a matrix of dots or by using the types 10 without being requested to switch the printer between the two ribbon feed modes.

Figure 5:
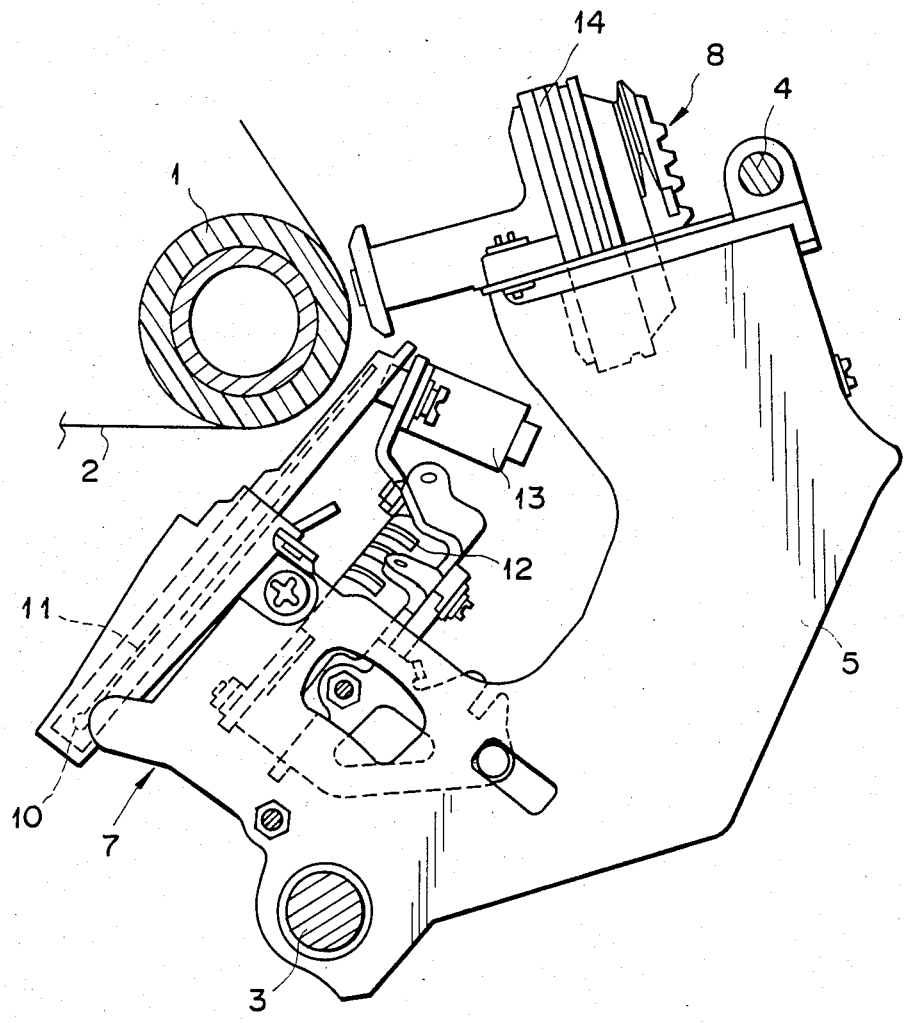
FIG. 5 is a side view of another embodiment of the invention.

FIG. 5 shows another embodiment of the invention. In the embodiment shown in FIGS. 1–4, the first printing section 7 and second printing section 8 are located in a side-by-side relation along the platen 1 on the carriage 5 and spaced apart from each other a suitable distance in a direction parallel to the axis of the platen 1 to print characters, symbols, etc., in the same line on the print sheet 2. In the embodiment shown in FIG. 5, however, the first printing section 7 and second printing section 8 supported on the carriage 5 are arranged such that their printing portions are suitably spaced apart from each other in a direction perpendicular to the axis of the platen 1. In this construction, printing is performed by using types when the carriage 5 is moved in one direction, for example, and then the print sheet is fed, to cover the aforesaid distance between the two printing sections 7 and 8, to bring the line of characters printed by the printing section 7 into alignment with the printing portion of the second printing section 8, before moving the carriage 5 in the reverse direction to print characters, symbols, etc., in a matrix of dots in the same line as those prnted by the types. Alternatively, after the line of characters printed by the printing section 7 is brought into alignment with the printing portion of the second printing section 8, the carriage 5 may be returned to the print initiating position and moved in one direction again to print characters, symbols, etc., in a matrix of dots in the same line as the characters, symbols, etc., have been printed by using the types.

In the embodiment shown in FIGS. 1–4, the ribbon casette 15 is removable mounted on the carriage 5 and the print ribbon 16 contained therein is trained over the first printing section 7 and second printing section 8. However, this arrangement is not restrictive and two ribbon cassettes may be used. More specifically, one ribbon cassette contains a print ribbon of a multiple strike type and is movably supported with the first printing section to feed a predetermined amount of the ribbon each time one character is printed, and the second ribbon cassette which is of a stationary type and contains a print ribbon of a fabric type is supported by the main body frame in a manner to cooperate with the second printing section so as to continuously feed the ribbon while printing is being performed. In a further embodiment, a stationary ribbon cassette containing a print ribbon is supported by the main body frame, and the ribbon cassette is trained over the first printing section and second printing section. When printing is performed by using types in the first printing section, the ribbon is fed intermittently in a predetermined amount each time one character is printed; when printing is performed in a matrix of dots in the second printing section, the ribbon is fed continuously.

What is claimed is:

1. In a combined printer comprising a first printing section for printing characters by using types, a second printing section for printing character patterns formed by a matrix of dots and a print ribbon for performing printing as the first printing section and second printing section are moved in the direction in which printing is to be performed in one line, a ribbon feed system comprising:

ribbon drive means for moving the print ribbon;

a first control unit for controlling the ribbon drive means in such a manner that the print ribbon is fed intermittently a predetermined distance each time one character is printed when the first printing section is rendered operative;

a second control unit for controlling the ribbon drive means in such a manner that the print ribbon is continuously fed when the second printing section is rendered operative; and a control means including a means for deciding whether print data inputted from outside are data to be printed by using the first printing section or data to be printed by using the second printing section, a first selecting means for selecting said first printing section when said deciding means decides that the print data inputted from outside are data to be printed by using the first printing section, and selecting said second printing section when said deciding menas decides that the print data inputted from outside are data to be printed by using the second printing section, and a second selecting means for selecting said first control unit in order to carry out intermittent feeding of said print ribbon when said first selecting step selects the first printing section and selecting said second control unit in order to carry out continuous feeding of said print ribbon when said first selecting step selects the second printing section.

2. A ribbon feed system of combined printer as claimed in claim 1 wherein said control means is a central processing unit (CPU) for selectively operating the first control unit or the second control unit corresponding to inputted data for either printing characters by using types or for printing characters in a matrix of dots from the external device.

* * * * *